US005313930A

United States Patent [19]

Kujawa et al.

[11] Patent Number: 5,313,930

[45] Date of Patent: May 24, 1994

[54] AIR INTAKE FOR FURNACE

[75] Inventors: Matthew Kujawa, Danville; Timothy J. Waterman, Carmel, both of Ind.

[73] Assignee: Carrier Corporation, Syracuse, N.Y.

[21] Appl. No.: 89,661

[22] Filed: Jul. 9, 1993

[51] Int. Cl.[5] ..... F24H 3/00

[52] U.S. Cl. ..... 126/116 R; 126/110 R

[58] Field of Search ..... 126/110 R, 116 R

[56] References Cited

U.S. PATENT DOCUMENTS

| | | | |
|---|---|---|---|
| 4,653,466 | 3/1987 | DeHaan et al. | 126/116 R |
| 4,960,102 | 10/1990 | Shellenberger | 126/116 R |
| 5,097,819 | 3/1992 | Talbert et al. | 126/110 R |

*Primary Examiner*—Carroll B. Dority

[57] ABSTRACT

An induced flow condenser furnace has a combustion air intake shoe that connects the combustion air pipe to the burner box, and has a provision for draining off any condensate from the combustion air pipe before it reaches the burner box. The shoe has a tray portion with an open top that mates with an intake opening in one wall of the burner box, and a tube portion that connects at one end with the combustion air pipe and at the other end with an end cap. The latter has a drain nipple to permit escape of the condensate. An internal lip is formed in the tube portion traps condensate when the furnace is poised in an inverted or downflow orientation. This permits the furnace to be poised in any of four orientations. The intake shoe facilitates connection of the inlet pipe and drain tube in all multi-poise configurations.

5 Claims, 5 Drawing Sheets

HORIZONTAL LEFT AIRFLOW

HORIZONTAL RIGHT AIRFLOW

AIR INTAKE FOR FURNACE

BACKGROUND OF THE INVENTION

The present invention is directed to space heating furnaces, and is in particular directed to an induction furnace of the type in which outside combustion air is supplied through a combustion air duct to the burners of the furnace and in which an inducer fan or blower exhausts the combustion products out through a vent duct.

The invention is more specifically directed to a furnace that can be installed in an conventional upflow configuration, an inverted, downflow configuration, or in a horizontal, i.e., right flow or left flow configuration, requiring only a nominal reconfiguration of the internal parts of the furnace.

Induction type furnaces have gained popularity in recent times because of their high efficiency and because they do not require a conventional stack for exhaust.

In a furnace of this type an inducer blower is energized to induce a draft, i.e. a flow of combustion air through the furnace heat exchanger. Combustion air is furnished from the outside environment through a combustion air duct or pipe to the furnace where it is coupled to an air inlet shoe. This air inlet shoe opens to a burner box that contains the gas burners. The latter are ignited when the inducer operates, and hot combustion products are fed into the heat exchanger. The heat exchanger is typically a two-stage system, with a primary heat exchanger stage, so called because most of the heat from the combustion gases is transferred to the circulating air from this heat exchanger. The primary heat exchanger is then followed by a secondary or condensing heat exchanger so called because water vapor in the combustion gases condenses here to yield additional heat. The inducer fan is then connected at the condensing heat exchanger's outlet and sends the exhaust through the vent pipe into the outside environment.

A furnace blower moves circulating room air from a return air duct, coupled to a comfort space, across the furnace heat exchanger to pick up heat. The heated circulation air then goes into a hot air plenum and is distributed through hot air ductwork back to the comfort space.

Under certain outdoor conditions, condensation can occur in the combustion air duct and must be drained out from the system. To drain accomplish condensate from the combustion air intake shoe, a drain line is attached to it, which leads down to a sump or trap device.

The air intake shoe is disposed on the wall of the burner box that is beneath the box when the furnace is poised in the conventional or upflow orientation. The combustion air pipe enters the furnace cabinet horizontally, i.e., through a side wall, to connect to the air intake shoe.

In the upflow orientation, drainage is not a difficult problem, as the condensate collects in the lower part of the shoe and then enters a drain line disposed at the lower part of the shoe.

In a horizontal orientation of the furnace, the combustion air pipe and the air inlet shoe are disposed vertically, so any condensate will collect at the lower side of the shoe, i.e., away from the combustion air pipe, and can be drained away easily.

However, it is in the inverted or downflow orientation of the furnace that drainage becomes a problem. Here, the air inlet shoe is oriented above the associated burner box, where the condensate can drip into the burner box causing corrosion. Accordingly, the air inlet shoe has to be suitably designed to address the problem of condensation in the downflow orientation, without significantly impairing combustion air intake, and further permitting the furnace to be installed in its other orientations.

OBJECTS AND SUMMARY OF THE INVENTION

It is an object of this invention to provide a direct vent, condensing type furnace that can be installed in any of the upflow, downflow, and horizontal orientations and which will drain away condensate that accumulates in the air intake in any of those orientations.

It is a related object to provide an air inlet shoe and an associated drain cap that ensures condensate drainage in any of the furnace's orientations.

According to an embodiment of this invention, an air inlet shoe for a direct vent, condensing furnace is configured to be coupled to the combustion air duct and to the burner box to supply combustion air to the gas burner or burners in the burner box. The air intake shoe has a tray portion with a bottom wall and sides and an open top that mates to an intake opening in a bottom wall of the burner box. A tube portion of the shoe extends across one side of the tray portion so that the latter protrudes radially from the tube portion. The tube portion has generally cylindrical left and right end portions. One of these end portions receives the combustion air duct or pipe, and the other is fitted with a cap or closure that contains a drain nipple, onto which the drain line is fitted. A central portion of the shoe tube portion, i.e. the portion from which the tray portion protrudes, has a generally cylindrical wall that is contiguous with the bottom wall of the tray portion but is open to the inside of the tray portion to permit air flow to the burner box. The central portion has a lip that depends into this open part below the top opening of the tray. When the furnace is installed in the inverted or downflow orientation, with the shoe over the burner box and the tray portion opening facing downwards, this lip traps the condensate in the shoe and channels it to the drain line at the appropriate end of the tube portion. This lip can favorably continue about 30 to 45 degrees of arc beyond the top opening.

The end cap or closure has the drain nipple at one edge but extending axially through the cap, and can be installed in either of two positions disposed 180 degrees apart, suitably for use in the upflow and downflow orientation respectively.

The above and many other objects, features, and advantages of this invention will become apparent from the ensuing description of a preferred embodiment to be read in conjunction with the accompanying Drawing.

DETAILED DESCRIPTION OF THE PREFERRED EMBODIMENT

Figure 1:
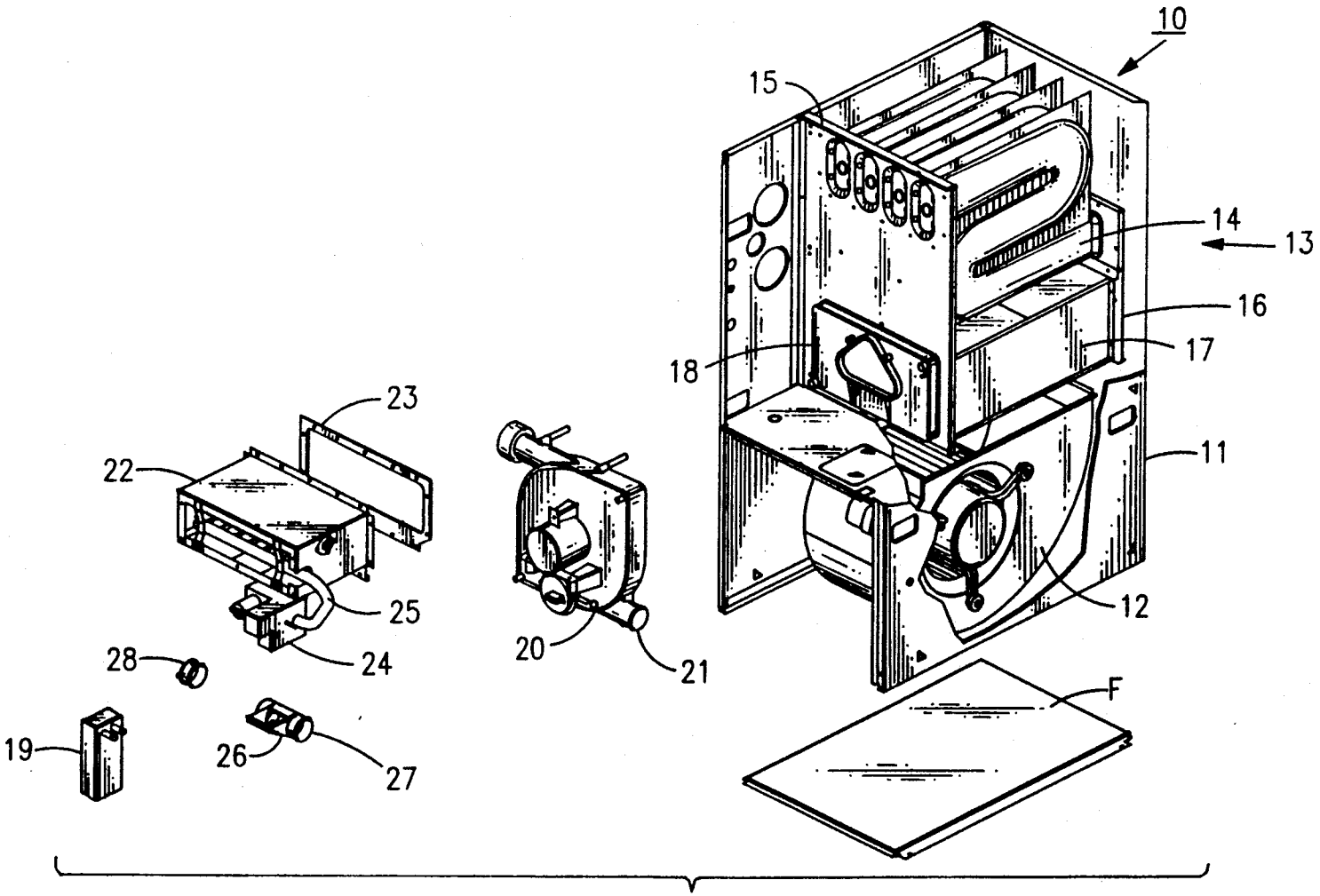
FIG. 1 is a general assembly view of a furnace according to an embodiment of this invention, here in its upright or upflow orientation.

With reference initially to FIG. 1 of the Drawing, a furnace 10 is here shown configured in an upflow orientation although it can be poised in a horizontal flow orientation or in a downflow orientation. A housing or cabinet 11 has a filter F at its base for filtering return air received from a cold air plenum (not shown). The air is blown upwards by a circulation blower 12 across a heat exchanger 13. The heat exchanger has a three-pass primary stage 14, here shown with burner opening 15, followed by a connector box 16 and a secondary or condensing heat exchanger stage 17. The secondary heat exchanger stage discharges combustion products into a collector box 18 mounted on the front of the heat exchanger. The collector box 18 collects condensed water vapor from the secondary stage and passes same to a trap 19 via a condensate drain. An inducer 20, i.e., a blower for inducing combustion air flow, is mounted on the collector box and blows gaseous combustion products through a vent outlet 21 thereof into an exhaust or vent pipe, which is not shown in this view.

A burner box 22 which houses the gas burners is mounted onto the front panel of the heat exchanger 13 and a gasket 23 provides an air-tight seal. A gas valve 24 supplies a burner manifold 25 with natural gas, propane or another suitable fuel gas received from a gas pipe (not shown). An air intake shoe 26 is mounted on one side, here on lower surface, of the burner box to furnish combustion air that it receives from a not-shown combustion air inlet pipe that connects to one end 27 of the air intake shoe 26. The inducer 20 is energized to exhaust combustion product gases through the vent pipe and thus induce an air flow through the inlet pipe and air intake shoe 26 into the burner box 22.

An end cap 28 fits the other end of the air intake shoe 26 and has means to connect to a drain line to pass condensate, which collects within the shoe 26, to the trap 19. This will be described in more detail later.

The furnace also has a control box that contains various electrical and electronic components, a twenty-four volt thermostat power supply, a flame sensor and various pressure sensors, to control operation of the furnace.

In this embodiment, the heated circulation air that has passed across the heat exchanger 13 and absorbed the heat of the combustion products proceeds upward to the hot air plenum, from which it returns through suitable ductwork to the comfort space.

Figure 2:
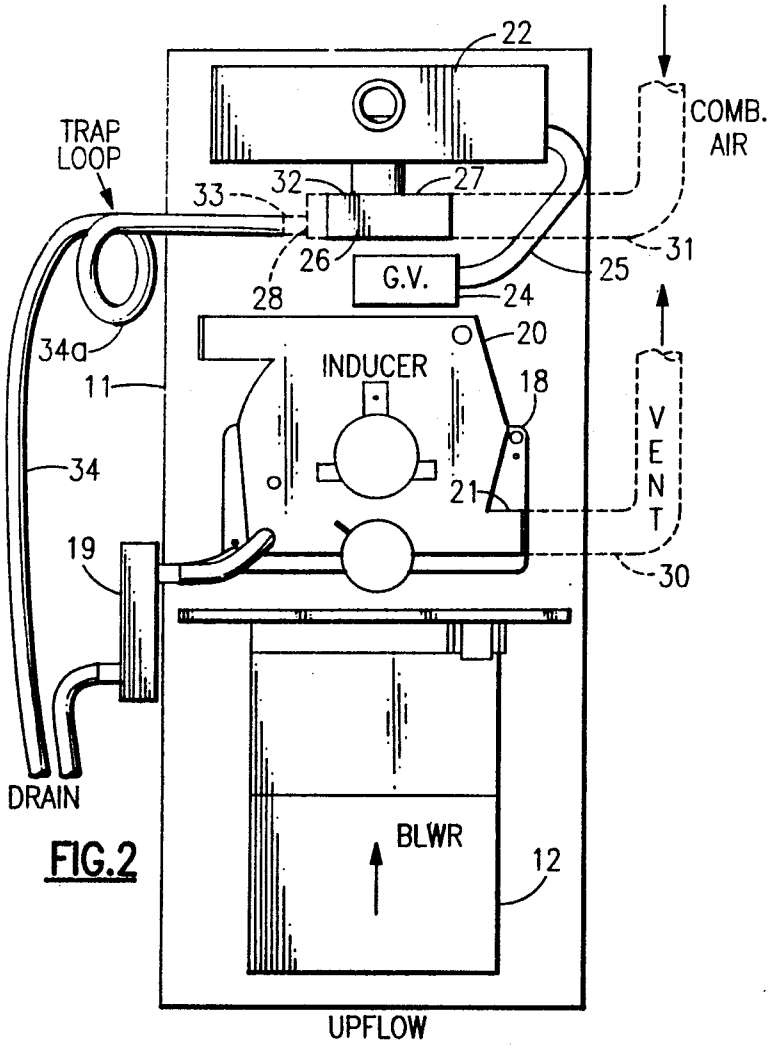

FIG. 2 illustrates the configuration of the furnace in an upflow orientation, which is frequently used in basement applications. Here a vent pipe 30 is shown connected to the vent outlet 21 of the inducer to conduct away the vent gases, and a combustion air pipe 31 is shown connected to the inlet end 27, here the right end, of the air intake shoe 26 to bring outside combustion air into the burner box 22. The end cap 28 is fitted into the left end 32 of the shoe 26, and is oriented with a drain outlet 33 on the lower side. Field-supplied drain tubing 34 connects to the drain outlet 33 and this field-supplied tubing incorporates a loop trap 34*a*.

In this case the vent pipe 30 and the combustion air pipe 31 run horizontally into the furnace to join the inducer and intake shoe. The shoe 26 is positioned below the burner box 22, and any condensate collects on the lower interior of the shoe. Condensate drains away from the burner box.

Figure 3:
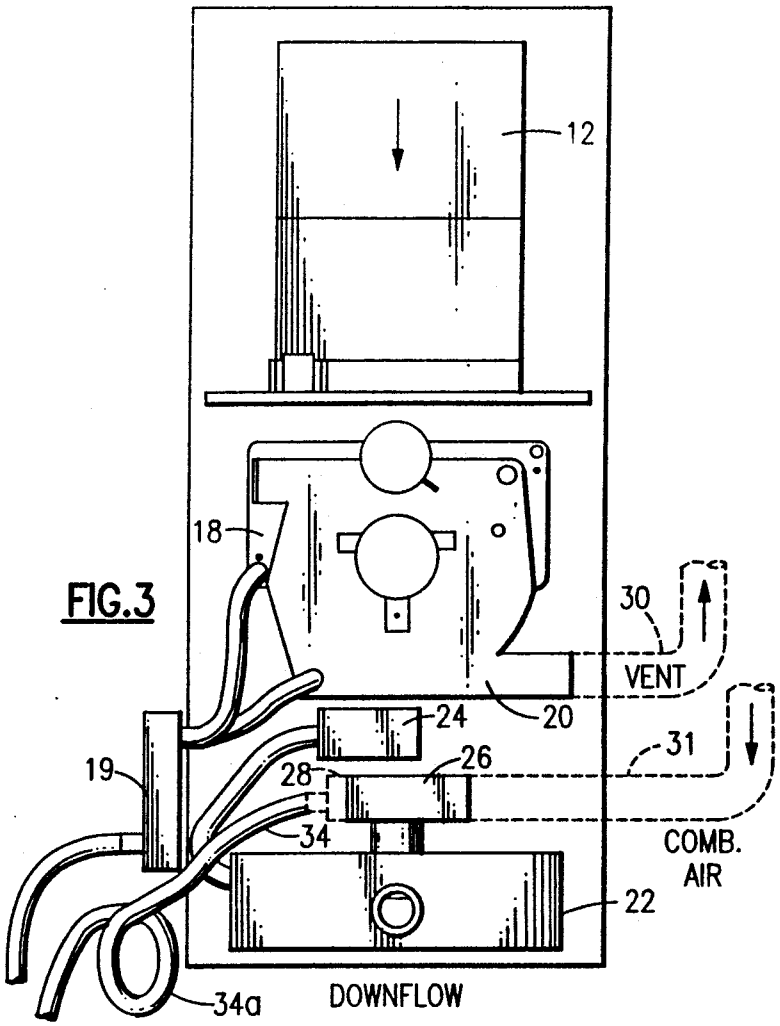
FIGS. 2, 3, 4, and 5 are schematic front views of the furnace, showing duct and drain connections in each of an upflow orientation, a downflow orientation, a horizontal left flow orientation, and a horizontal right flow orientation, respectively.

FIG. 3 illustrates the configuration of the furnace in a downflow orientation, i.e., an orientation inverted with respect to what is shown in FIG. 2. Here, as in FIG. 2, the vent pipe 30 and combustion air pipe 31 run horizontally into the furnace, but the positions of the elements in the furnace are inverted, with the blower 12 disposed on top directing the flow of circulation air downwards. Also, the intake air shoe 26 is positioned atop the burner box 22. Here the end cap 28 is rotated and positioned with the drain outlet 33 on the side closest the burner box, and the drain tubing 34 angles slightly downward. The FIG. 3 installation can be used for a closet application, where the hot air plenum beneath the furnace connects through suitable ductwork to floor registers.

Figure 4:
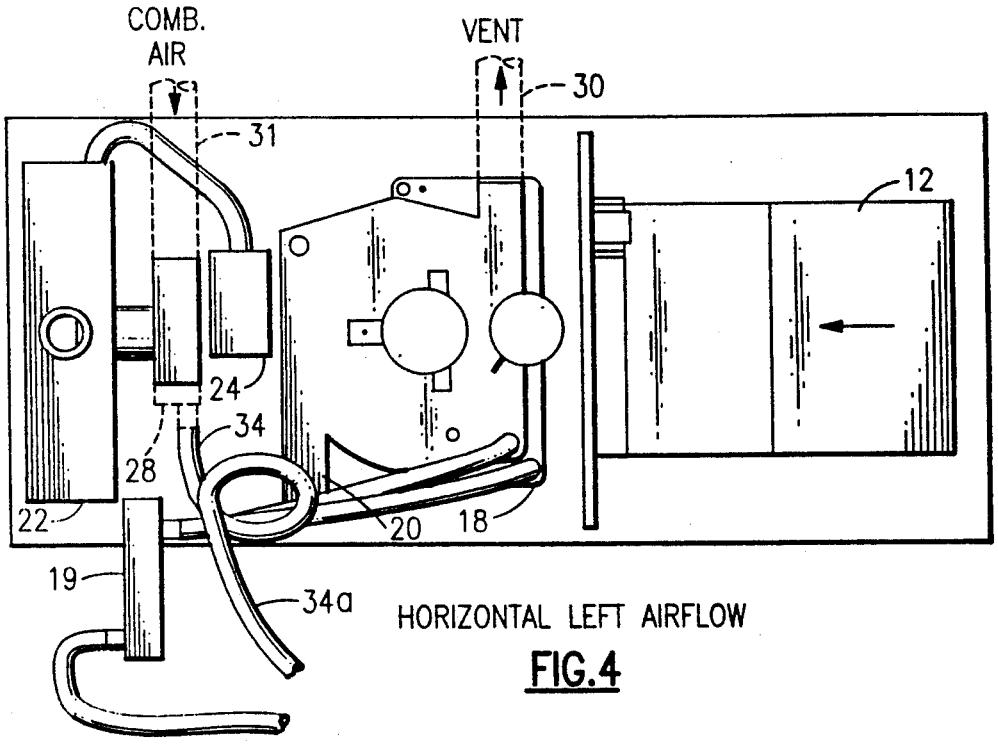
Figure 5:
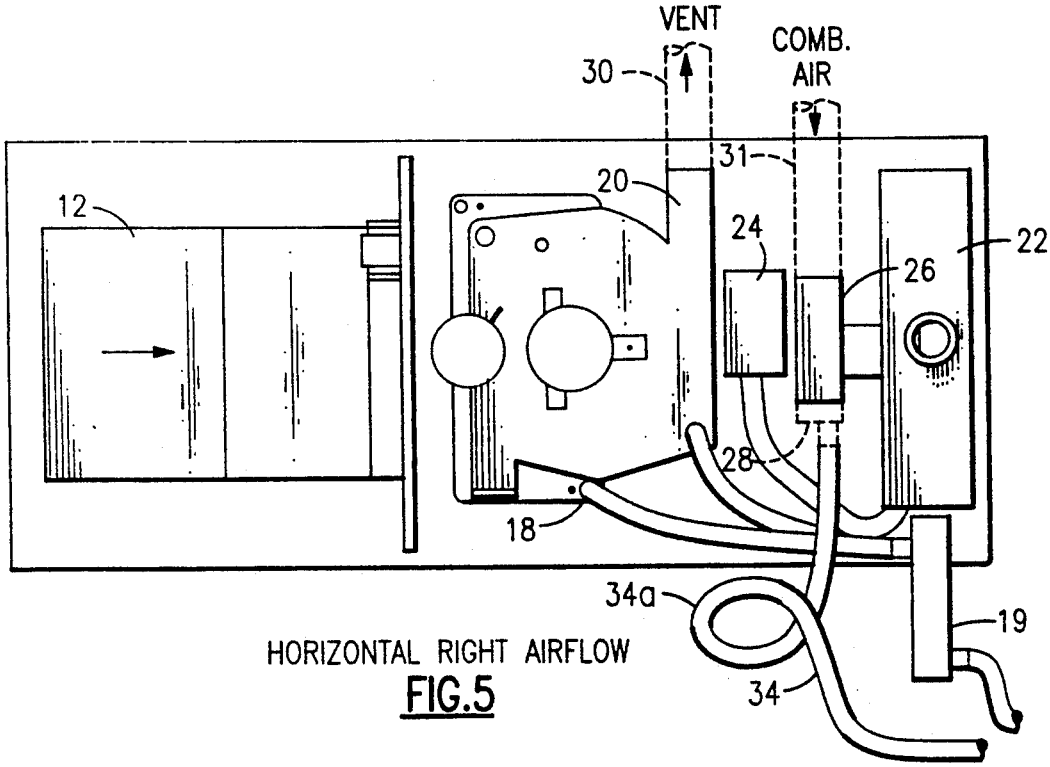

FIGS. 4 and 5 illustrate horizontal orientations of the furnace, which can be employed where vertical height for the furnace is quite limited, e.g., in an attic or crawl space application. These two orientations differ from one another principally in the direction of the blower 12, i.e., on the right blowing left (FIG. 4) or on the left blowing right (FIG. 5). In each case the vent pipe 30 and combustion air pipe 31 run vertically down into the furnace, and in each case the end cap 28 is at a lower end of the shoe 26 and is connected to vertical drain tubing 34.

Figure 6:
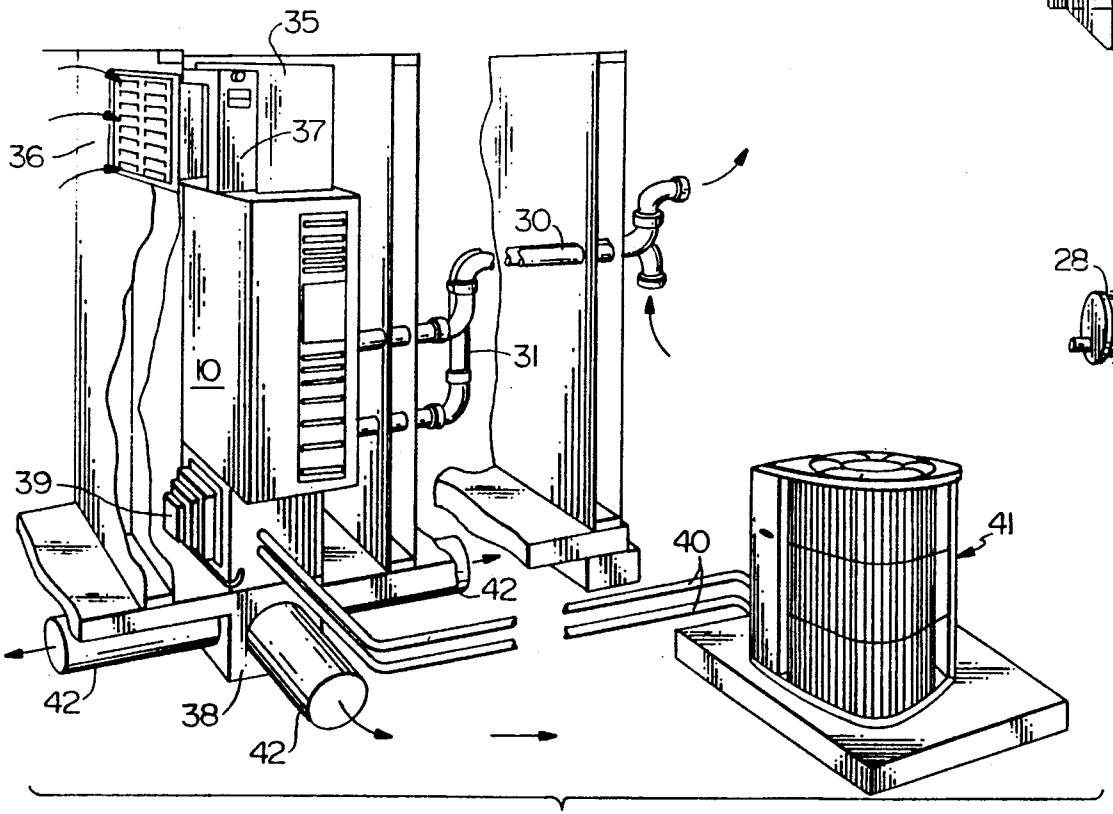
FIG. 6 is an installation application view of the furnace in its downflow orientation.
Figure 8:
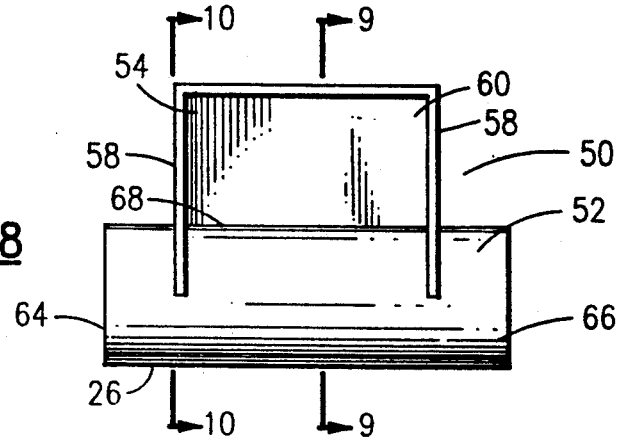
FIG. 8 is a top plan view of the air intake shoe of an embodiment of this invention.
Figure 9:
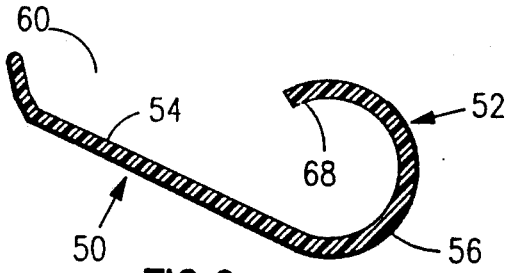
FIGS. 9 and 10 are cross sectional views taken at 9—9 and 10—10 of FIG. 8.
Figure 10:
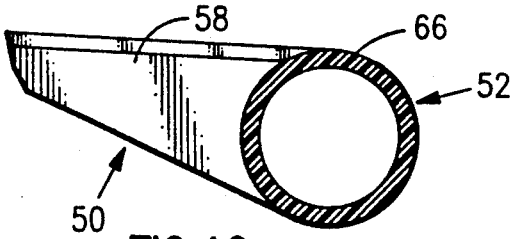

The downflow orientation of FIG. 2 is useful in many applications, a typical one of which is shown in FIG. 6, in which the furnace 10 is installed in a closet within a dwelling or other occupied space. Here a circulation return air intake plenum 35 is situated above the furnace, and is shown here with a return air inlet 36 and an electronic air cleaner 37. Below the furnace 10 is a hot air plenum 38 on which a humidifier 39 is mounted and which also contains an air conditioning/heat pump coil. The latter is connected by suitable conduits 40 to an outdoor unit 41 containing the compressor, outdoor blower, and evaporator/condenser coil. Under-floor ducting 42 supplies conditioned air from the plenum 38 to floor registers in the comfort space. This downflow configuration represents an optimal orientation for an application of this type.

Also seen here are the vent and combustion air pipes 30,31 penetrating an exterior wall to reach the exterior environment.

The construction of the air intake shoe 26 of this invention, which satisfies the criteria identified above can be explained with reference to FIGS. 7-12. The water that accumulates in the combustion air piping has to be channeled away before it reaches the burner box, and this must be true for all of the orientations of the multipoise furnace; downflow as well as the upflow and horizontal orientation.

Figure 7:
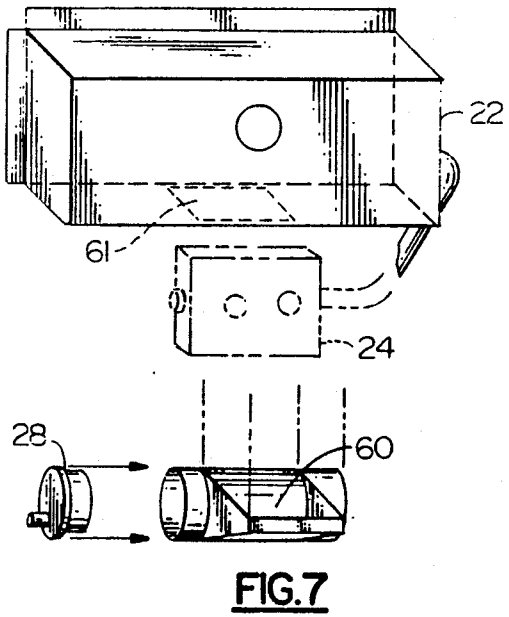
FIG. 7 is a subassembly view of the air intake shoe and burner box.

FIG. 7 shows the air intake shoe 26 and burner box 22 in the standard upflow orientation. The terms of orientation identifying the respective portions of the burner box and shoe are taken with respect to this configuration, with the shoe 26 positioned below the burner box 22. However, the parts themselves remain the same, even where disposed in another orientation such as the horizontal positions of FIGS. 4 and 5 or the inverted downflow position of FIGS. 3 and 6.

As shown, in FIG. 7, 8, 9, and/or 10 the shoe 26 has a tray portion 50 that protrudes laterally, i.e., radially, from a tube portion 52. The tray portion has a bottom wall 54 that is contiguous with a cylindrical wall 56 of the tube portion 52, and side walls 58. The tray portion 50 has an open top 60 that mates with an intake opening 61 on the underside of the burner box 22. The tube portion 52 has a central portion 62 that extends between the tray side walls 58. This portion 62 is open to permit air to flow into the tray portion 50 and thence into the burner box. The tube portion 52 has left and right tubular end portions 64 and 66, each protruding a short distance beyond the tray portion 50.

The cylindrical wall 56 continue curving inward beyond the open top portion 60 for about 30 to 45 degrees of arc, forming an interior lip 68. This lip 68 forms a channel or trough when the shoe 26 is oriented with the opening 60 facing downward on top of the burner box. This lip accumulates the condensate and carries it to the end cap 28 where it escapes through a drain hole in the nipple 33.

The cap 28 can be oriented in either of two positions in the tube end portion 64 or 66 that is remote from the combustion air pipe. In the upflow furnace orientation, the cup 28 is installed with the nipple 33 down, i.e, away from the burner box. Water accumulates in the tube portion 52 and passes through the nipple 33 and drain line 34 to the trap 19.

In the horizontal orientations, the cap 28 is at the lower of the two end portions 64 or 66 and condensate collects and passes out in either of the two orientations of the cap 28.

In the downflow orientation, the cap 28 is installed with the nipple 33 aligned with the trough formed by the internal lip 68. Here, the condensate that is trapped by the lip 68 passes to the drain line 34 through the nipple 33.

Figure 11:
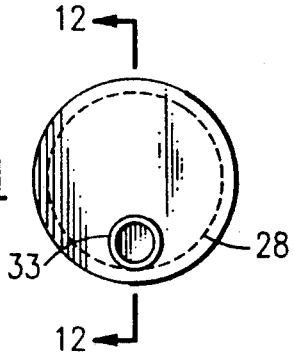
FIG. 11 is an end view of an end cap for the air intake shoe.
Figure 12:
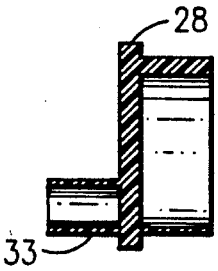
FIG. 12 is a cross sectional view taken at 12—12 of FIG. 11.

The end cap 28 is shown in FIGS. 11 and 12, and is dimensioned to fit into either of the end portions 64, 66 of the shoe tube portion. This permits the combustion air pipe to be installed through either side of the furnace.

While the invention has been described with reference to a selected preferred embodiment, it should be recognized that the invention is not limited to that precise embodiment. Rather, many modifications and variations will present themselves to persons of ordinary skill in the art without departing from the scope and spirit of the invention, as defined in the appended claims.

What is claimed is:

1. An air intake shoe for a direct vent, condensing furnace of the type in which a combustion air duct brings outside combustion air to the furnace, said intake shoe is coupled to said combustion air duct to supply combustion air to a burner box that contains at least one gas burner, a heat exchanger receives hot combustion products from the burner, an inducer coupled to a discharge side of the heat exchanger exhausts the combustion products into an exhaust vent duct and induces a flow of said combustion air from said combustion air duct through said intake air shoe and said burner box, and a drain line is coupled to said air intake shoe to drain condensate therefrom; wherein said air intake shoe comprises a tray portion having a bottom wall and side walls and a top opening that fits an intake opening in the burner box, and a tube portion having left and right generally cylindrical end portions one of which is connected to said combustion air duct and the other of which is coupled to said drain line, and a central portion therebetween from which said tray portion protrudes radially, said central portion having a generally cylindrical wall that is contiguous with the bottom wall of the tray portion but which opens to the tray portion to permit combustion air to flow to the burner box, and has a lip dispensing below said top opening, such that when said furnace is installed in an inverted, downflow orientation with said top opening facing downward atop said burner box, said lip traps condensate in said shoe and channels it to said drain line.

2. An air intake shoe according to claim 1 wherein said drain line includes an end cap fitting into said other end portion to close same and including a drain nipple extending generally axially from an edge of the end cap.

3. An air intake shoe according to claim 2 wherein said end cap is removable and can be installed in either of two positions 180 degrees from each other, one position being with the drain nipple remote from the top opening for an upflow orientation of said furnace, and the other position being with the drain nipple near the top opening for the downflow orientation of said furnace.

4. An air inlet shoe according to claim 1 wherein said cylindrical wall continues about 30 to 45 degrees of arc beyond said top opening to form said lip.

5. Air inlet shoe according to claim 2 wherein said left and right generally cylindrical end portions are both of the same diameter, such that the combustion air duct can be connected to either of the end portions and said end cap can be installed in the other of the two end portions.

* * * * *